United States Patent [19]

Lowe

[11] 4,088,587

[45] May 9, 1978

[54] LUBRICATING OIL ADDITIVE COMPOSITIONS

[75] Inventor: Warren Lowe, El Cerrito, Calif.

[73] Assignee: Chevron Research Company, San Francisco, Calif.

[21] Appl. No.: 624,204

[22] Filed: Oct. 20, 1975

[51] Int. Cl.[2] ..... C10M 1/48; C10M 3/42; C10M 5/24; C10M 7/46

[52] U.S. Cl. ..... 252/32.7 E; 252/45; 252/46.7; 252/48.6; 252/49.9; 252/400 A

[58] Field of Search ..... 252/32.7 E, 49.9, 400 A, 252/45, 48.6, 46.7

[56] References Cited

U.S. PATENT DOCUMENTS

| | | | |
|---|---|---|---|
| 3,562,159 | 2/1971 | Mastin | 252/32.7 E |
| 3,652,410 | 3/1972 | Hollinghurst et al. | 252/32.7 E |
| 3,732,167 | 5/1973 | Foucher et al. | 252/32.7 E |
| 3,846,317 | 11/1974 | Lintzenich | 252/49.9 |
| 3,868,376 | 2/1975 | Hotten | 252/49.9 |
| 3,909,425 | 9/1975 | Crawford et al. | 252/32.7 E |

*Primary Examiner*—Delbert E. Gantz
*Assistant Examiner*—Irving Vaughn
*Attorney, Agent, or Firm*—C. J. Tonkin; J. J. DeYoung

[57] ABSTRACT

A lubricating oil additive composition which imparts improved oxidation properties to lubricants and industrial oils comprises an antioxidant selected from oil-soluble, sterically hindered phenols or thiophenols, oil-soluble aromatic amines and organic sulfur compounds containing from 3 to 40 weight percent sulfur which is present within the compound as an organic sulfide or polysulfide or mixtures thereof, and a phosphorus-containing composition prepared by reacting phosphorus oxychloride or phosphorus thiochloride with a 1,2-substituted imidazoline in which the 1-substituent is hydroxyalkyl of 1 to 10 carbon atoms and the 2-substituent is an aliphatic hydrocarbon of 6 to 24 carbon atoms or an oil-soluble N-aliphatic-substituted amino alkylene amide of a higher fatty acid containing 6 to 24 carbon atoms and containing a terminal hydroxy group in the aliphatic substituent, said alkylene group containing from 2 to 5 carbon atoms and said aliphatic radical containing 1 to 10 carbon atoms, or mixtures thereof, the weight ratio of antioxidant to phosphorus-containing compound being 1:0.001–21. Compositions containing this antioxidant additive composition preferably contain from 2 to 40 millimols of zinc per kilogram present as an cil-soluble salt.

15 Claims, No Drawings

LUBRICATING OIL ADDITIVE COMPOSITIONS

BACKGROUND OF THE INVENTION

This invention relates to an improved lubricating composition, and more particularly this invention relates to a lubricating composition containing an additive combination having improved antioxidation properties.

Hydrocarbon oils are partially oxidized when contacted with oxygen at elevated temperatures for prolonged periods. The internal combustion engine is a model oxidator, since it contacts a hydrocarbon motor oil with air under agitation and at high temperatures. Also, many of the metals (iron, copper, lead, nickel, etc.) used in the manufacture of the engine and in contact with both the oil and air are effective oxidation catalysts which increase the rate of oxidation. The oxidation in motor oils is particularly acute in the modern internal combustion engine, which is designed to operate under heavy workloads and at elevated temperatures.

The oxidation process produces acidic bodies within the motor oil which are corrosive to typical copper-lead and cadmium engine bearings. It has also been discovered that the oxidation products contribute to piston ring sticking, the formation of sludges within the motor oil and an over-all breakdown of viscosity characteristics of the lubricant.

Several effective oxidation inhibitors have been developed by lubricant industries and their employment has been utilized in almost all of the conventional motor oils today. Typical of these inhibitors are the sulfurized oil-soluble organic compounds, such as sulfurized sperm oil, sulfurized fatty acid esters, sulfurized terpenes, sulfurized polybutenes, etc., as well as zinc dithiophosphates and the oil-soluble phenolic and aromatic amine antioxidants. These inhibitors, while exhibiting good antioxidation properties, are burdened by economic and oil-contamination problems. It is preferred to maintain the sulfur content of the oil as low as possible while at the same time receiving the benefits of the antioxidation property. A need, therefore, exists for an improved antioxidant that is stable at elevated temperatures, that can be employed at reduced concentrations and that is economical and easy to produce.

It is an object of this invention to provide additive compositions for lubricants and industrial oils which impart improved antioxidation properties. It is a further object of this invention to provide a synergistic composition having antioxidation properties. It is still another object of this invention to provide lubricating oil compositions having improved antioxidation properties. A further object of this invention is to provide a method of inhibiting oxidation of motor oils.

Other additional objects will become apparent from the following description of the invention and accompanying claims.

SUMMARY OF THE INVENTION

A lubricating oil additive composition which imparts improved oxidation properties to lubricants and industrial oils comprises an antioxidant selected from oil-soluble, sterically hindered phenols or thiophenols, oil-soluble aromatic amines and organic sulfur compounds containing from 3 to 40 weight percent sulfur which is present within the compound as an organic sulfide or polysulfide or mixtures thereof, and a phosphorus-containing composition prepared by reacting phosphorus oxychloride or phosphorus thiochloride with a 1,2-substituted imidazoline in which the 1-substituent is hydroxyalkyl of 1 to 10 carbon atoms and the 2-substituent is an aliphatic hydrocarbon of 6 to 24 carbon atoms or an oil-soluble N-aliphatic-substituted amino alkylene amide of a higher fatty acid containing 6 to 24 carbon atoms and containing a terminal hydroxy group in the aliphatic substituent, said alkylene group containing from 2 to 5 carbon atoms and said aliphatic radical containing 1 to 10 carbon atoms, or mixtures thereof.

As a second embodiment there is provided a lubricating oil composition comprising: (1) a major portion of an oil of lubricating viscosity, a combination of (2) from 0.25 to 10 weight percent of an antioxidant selected from oil-soluble, sterically hindered phenols and thiophenols, oil-soluble aromatic amines and oil-soluble organic sulfur compounds containing from 3 to 40 weight percent sulfur present within the compound as organic sulfides and polysulfides or mixtures thereof, (3) from 0.01 to 5 weight percent of a phosphorus-containing composition prepared by reacting phosphorus oxychloride or phosphorus thiochloride with a 1,2-substituted imidazoline in which the 1-substituent is hydroxyalkyl of 1 to 10 carbon atoms and the 2-substituent is an aliphatic hydrocarbon of 6 to 24 carbon atoms, or an oil-soluble N-aliphatic-substituted amino alkylene amide of a higher fatty acid containing 6 to 24 carbon atoms and containing a terminal hydroxyl group in the aliphatic substituent, said alkylene group containing from 2 to 5 carbon atoms and said aliphatic radical containing 1 to 10 carbon atoms, or mixtures thereof, and optionally (4) from 2 to 40 mmols of zinc per kilogram, present as an oil-soluble zinc salt.

While the precise effect of the combination of the antioxidant and phosphorus-containing composition in imparting antioxidation properties to the lubricating oil is unknown, it has been found that these two components complement each other in a synergistic manner resulting in a combination having properties superior to either additive alone. With the instant combination, the amount of phenolic, aromatic amine, or sulfurized antioxidant necessary in order to impart the desired properties to a lubricating oil, functional fluid or industrial oil blend is significantly less than that amount needed when the synergistic phosphorus-containing compound is not present. The presence of the zinc salt leads to a lubricating composition having improved antioxidant properties; however, the zinc salt is not required in order to achieve a synergistic effect from the combination of the antioxidant and the phosphorus-containing composition.

DETAILED DESCRIPTION OF THE INVENTION

The compositions of this invention are highly stable additives for lubricants and industrial oils and exhibit excellent antioxidation properties. These lubricants are quite useful in motor oils for internal combustion engines, particularly in gasoline engines operated at elevated temperatures and for greases, gear oils and industrial lubricants. These lubricants may also be used in rotary engines, transmission fluids, hydraulic systems, turbines, etc.

The additive composition of this invention which imparts improved antioxidation properties to lubricants and industrial oils comprises: (1) an antioxidant selected from oil-soluble, sterically hindered phenols or thiophenols, oil-soluble aromatic amines and organic sulfur compounds containing from 3 to 40 weight percent sulfur which is present within the compound as an organic sulfide and polysulfide, or mixtures thereof, (2) a phosphorus-containing composition prepared by reacting phosphorus oxychloride or phosphorus thiochloride with a 1,2-substituted imidazoline in which the 1-substituent is hydroxyalkyl of 1 to 10 carbon atoms and the 2-substituent is an aliphatic hydrocarbon of 6 to 24 carbon atoms, or an oil-soluble N-aliphatic-substituted amino alkylene amide of a higher fatty acid containing 6 to 24 carbon atoms and containing a terminal hydroxyl group in the aliphatic substituent, said alkylene group containing from 2 to 5 carbon atoms and said aliphatic radical containing 1 to 10 carbon atoms, or mixtures thereof, the weight ratio of antioxidant to phosphorus-containing compound being 1 to 0.001–21. The lubricant compositions of this invention comprise a major portion of lubricating oil, from 0.25 to 10 weight percent of component (1) above, from 0.001 to 5 weight percent of component (2) above, and, preferably, from 2 to 40 millimols zinc per kilogram, present as an oil-soluble zinc salt.

In a preferred embodiment of the lubricating oil composition, the antioxidant is present in an amount from 0.25 to about 2 weight percent.

In a further preferred embodiment, the phosphorus-containing compound is present in an amount of 0.01 to 0.3, preferably 0.05 to 0.3, weight percent.

In a further preferred embodiment, the oil-soluble zinc salt is present in an amount of from 9 to 30 mmols/kg.

Antioxidant Component

The class of antioxidants which may be employed in the practice of this invention include oil-soluble, sterically hindered phenols and thiophenols, oil-soluble aromatic amines and oil-soluble organic sulfur compounds containing from 3 to 40 weight percent sulfur which is present within the compound as organic sulfide and polysulfide, and mixtures of these antioxidants.

Included within the definition of phenolic and thiophenolic antioxidants are sterically hindered phenolics such as hindered phenols and bis-phenols, hindered 4,4'-thiobisphenols, hindered 4-hydroxy- and 4-thiolbenzoic acid esters and dithio esters, and hindered bis(4-hydroxy- and 4-thiolbenzoic acid and dithio acid) alkylene esters. The sterically hindered phenols and benzoic acid esters are the preferred phenolic antioxidants.

The sterically hindered phenolics have the basic groups:

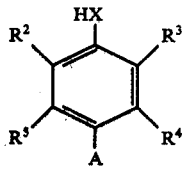

wherein: X is sulfur or oxygen and preferably oxygen; $R^2$ and $R^3$ are alkyl groups which sterically hinder the HX group and preferably have from 3 to 10 carbons and are usually branched-chain; $R^4$ and $R^5$ are the same or different substituents selected from hydrogen or a $C_1$–$C_4$ alkyl and preferably hydrogen; and A is defined infra.

The phenolic moiety is substituted in both positions ortho to the hydroxy or thiol groups with alkyl groups which sterically hinder these groups. Such alkyl substituents usually have 3 to 10 carbons, preferably 4 to 8 carbons, one generally branched rather than straight-chain, e.g., t-butyl, t-amyl, and the like.

The first group of hindered phenolic antioxidants is the single hindered phenols - i.e., where A in the above formula is hydrogen or a $C_1$ to $C_{10}$ alkyl group. Examples of such compounds include 2,6-di-tert-butylphenol, 2,6-di-tert-butyl-p-cresol, 2,6-di-tert-amyl-p-cresol; 2-tert-butyl-6-tert-amyl-p-cresol, etc. Trialkylated monohydroxy phenols which may be employed herein are disclosed in U.S. Pat. No. 2,265,582.

A second group of hindered phenolic antioxidants is the hindered bis-phenols. In this case, A is a bond to another basic phenolic group, preferably through an intervening $C_1$ to $C_4$ alkylene group. Examples of these compounds include 4,4'-methylene bis(2,6-di-tert-butyl phenol), 4,4'-dimethylene bis(2,6-di-tert-butyl phenol), 4,4'-trimethylene bis(2,2-di-tert-amyl phenol), 4,4'-trimethylene bis(2,6-di-tert-butyl phenol), etc.

Another group of hindered phenolic antioxidants is the hindered 4,4'-thio bis-phenols, i.e., where A in the formula is sulfur connected to another phenolic group. Examples of these compounds include 4,4'-thio bis(2,6-di-tert-butyl phenol), 4,4'-thio bis(2,6-di-sec-butyl phenol), 4,4'-thio bis(2-tert-butyl-6-isopropyl phenol), 4,4'-thio bis(2-methyl-6-t-butyl phenol, etc. These compounds and their preparations are described in detail in U.S. Pat. No. 3,326,800, which is herein incorporated by reference.

A fourth group of hindered phenolic antioxidants is 4-hydroxy- and 4-thiolbenzoic monothio or dithiobenzoic acid esters, i.e., A in the above formula is a $C_2$–$C_{21}$ ester or a dithio ester group. Exemlary compounds of this group include 3,5-di-t-butyl-4-hydroxy benzoic acid methyl ester, 3,5-di-t-butyl-4-hydroxy dithiobenzoic acid methyl ester, 3,5-di-t-butyl-4-hydroxybenzoic acid n-octyl ester, 3,5-di-t-butyl-4-hydroxy dithiobenzoic acid n-octyl ester, 3,5-di-t-butyl-4-hydroxy dithiobenzoic acid n-octyl ester, 3,5-di-t-butyl-4-hydroxy dithiobenzoic acid hydroxypropylene oxypropylene ester, etc.

Another group of hindered phenolic antioxidants are bis(4-hydroxy- or 4-thiolbenzoic acid or dithiobenzoic acid) alkylene esters, i.e., A in the above formula is a $C_2$–$C_{21}$ diester or dithio ester connected through an alkylene linkage to another phenolic group. Exemplary compounds of this type include bis(3,5-di-t-butyl-4-hydroxy dithiobenzoic acid) methylene ester, bis(3,5-di-t-butyl-4-hydroxy dithiobenzoic acid) ethylene ester, etc. The preparation of these compounds is the same as set forth above, except that the monohalo hydrocarbon is replaced with a dihalohydrocarbon.

Included within the definition of oil-soluble aromatic amine antioxidants are amino phenols, naphthyl-phenyl amines, phenyl alkyl amines, etc. The preferred aromatic amines have the basic group:

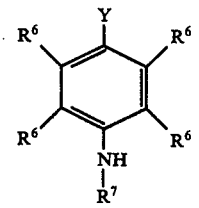

wherein Y is the same or different substituent selected from OH, SH, H, R, $NHR^6$ or $NHR^7$; $R^6$ is the same or different subsubstituent selected from H, or a $C_1$ to $C_4$ alkyl; and $R^7$ is a $C_1$ to $C_{18}$ alkyl.

Examples of aromatic amine antioxidants included within the above formula include the hydroxyl and thiol amines, such as N-n-butyl-p-amino phenol, N-ethyl-sec-butyl-p-amino phenol, N-n-butyl-p-amino thiophenol, N-n-butyl-p-amino-2-methylphenol, the phenylene diamines such as N,N'-di-sec-butyl-phenylene diamine, N,N'-bis(1,4-dimethylpentyl)-p-phenylene diamine, N,N'-diphenyl-p-phenylene diamine, N,N'-di-p-napthyl-p-phenylene diamine, N,N'-methyl-ethyl-p-phenylene diamine, N,N'-di-n-butyl-p-phenylene diamine, etc., the naphthylamines such as N-phenyl-alpha-naphthylamine, N-phenyl-beta-naphthylamine, N-p-methylphenyl-alpha-naphthylamine, etc., and the diphenylamines such as di-sec-butyldiphenylamine, di-isobornyl-di-phenylamine, and dioctyldiphenylamine.

These antioxidants can be prepared by known processes and many of them are commercially available. Because these processes are well known in the art, a description thereof is not necessary.

The organic sulfur compounds which may be employed in the practice of this invention include a wide range of compounds containing from 3 to 40 weight percent sulfur which is present within the compound as organic sulfides and polysulfides. The presence of sulfur in other forms, such as sulfonates, sulfates, etc., may exist within the compound but is not included in the calculation of the sulfur content of the organic sulfur compound. The compound may contain elements other than carbon, hydrogen and sulfur without adversely affecting properties of the composition and include elements such as oxygen, which may be present as ethers, ketones, carboxyls, esters, alcohols, etc., phosphorus, nitrogen present as amines, amides, imides, etc., as well as metals such as alkali metals, alkaline earth metals, etc.

One class of organic sulfur compounds which may be employed herein is the sulfurized fatty acid esters. These compounds are prepared by contacting sulfur with an unsaturated fatty ester under elevated temperatures. Typical esters include $C_1$ to $C_{20}$ alkyl esters of $C_8$–$C_{24}$ unsaturated fatty acids, such as palmitoleic, oleic, ricinoleic, petroselinic, vaccenic, linoleic, linolenic, oleostearic, licanic, parinaric, tariric, gadoleic, arachidonic, cetoleic, etc. Particularly good results have been obtained with mixed unsaturated fatty acid esters such are obtained from animal fats and vegetable oils such as tall oil, linseed oil, olive oil, castor oil, peanut oil, rape oil, fish oil, sperm oil, etc.

Exemplary fatty esters include lauryl tallate, methyl oleate, ethyl oleate, lauryl oleate, cetyl oleate, cetyl linoleate, lauryl ricinoleate, oleyl linoleate, oleyl stearate, etc.

These compounds can be phosphosulfurized by contacting the fatty esters with phosphorus pentasulfide along with the sulfur to produce a sulfurized-phosphosulfurized ester. They may be further reacted with a $C_3$ to $C_6$ alkylene polyamine having from 2 to 5 nitrogens to impart varnish-inhibiting properties to the lubricant.

Another class of organic sulfur compounds which may be employed in the practice of this invention includes sulfurized olefins prepared by the reaction of a $C_3$–$C_6$ olefin or a low-molecular-weight polyolefin derived therefrom with a sulfur-containing compound such as sulfur monochloride, sulfur dichloride, etc.

Cross-sulfurized ester olefins such as a sulfurized mixture of $C_{10}$–$C_{25}$ olefins with fatty acid esters of $C_{10}$–$C_{25}$ fatty acids and $C_1$–$C_{25}$ alkyl or alkenyl alcohols, wherein the fatty acid and/or the alcohol is unsaturated, may also be employed in this invention.

Another class of organic sulfur-containing compounds which may be used in the practice of this invention is sulfurized aliphatic esters of an olefinic mono- or dicarboxylic acid, for example aliphatic alcohols of 1–30 carbon atoms, used to esterify monocarboxylic acids such as acrylic acid, methacrylic acid, 2,4-pentadienoic acid and the like, or fumaric acid, maleic acid, muconic acid, and the like. Sulfurization is carried out by combining the above-described esters with elemental sulfur, sulfur monochloride or sulfur dichloride.

Another class of organic sulfur compounds which may be employed in the practice of this invention includes sulfurized terpenes, such as sulfurized pine oil, sulfurized terpinolene, sulfurized dipentene, sulfurized pinene, etc.

Sulfurized olefins such as $C_8$ to $C_{30}$ mono and poly ethylenically unsaturated aliphatic hydrocarbons may also be employed. Aromatic and alkyl sulfides may be employed such as dibenzyl sulfide, dixylyl disulfide, dicetyl sulfide, diparaffin wax sulfide and polysulfide, etc. Paraffin wax thiomers as described in U.S. Pat. No. 2,346,156 may be employed.

Another type of organic sulfur compound which may be employed is amido-substituted dithiazole-thiones. These compounds are believed to have the general structural formula:

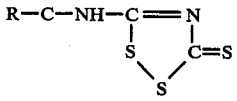

wherein R is a hydrocarbyl having from 8 to 24 carbons.

"Hydrocarbyl" as defined herein is a monovalent organic radical composed essentially of hydrogen and carbon and may be aliphatic, aromatic, or alicyclic or combinations thereof and may be saturated or unsaturated. The preferred hydrocarbyl is an alkyl.

The amido-substituted dithiazole compounds may be prepared by reacting amino dithiazole-thione with a hydrocarbonyl chloride (RCOCl) in the presence of an inert reaction solvent at moderate reaction conditions.

Another class of sulfurized compounds include $C_{10}$ to $C_{30}$ sulfurized hydroxyesters. These compounds are prepared by reacting a fatty acid of the type mentioned supra with a $C_2$ to $C_{20}$ aliphatic epoxide and then contacting the reaction product with sulfur under elevated conditions.

Another class of sulfurized compounds which may be advantageously employed in the practice of this invention comprise the polyalkylphenol sulfides. These compounds have the general structural formula:

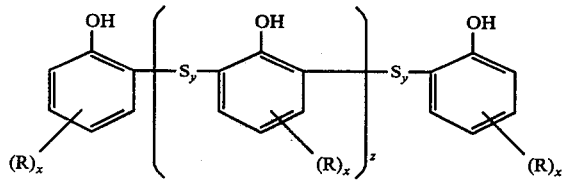

wherein R is an alkyl having from 5 to 24 carbons; $x$ is an integer from 1 to 3; $y$ is an integer from 1 to 5; and $z$ is an integer from 0 to 5.

Compounds having the above formula are prepared by contacting an alkylated phenol with sulfur mono- or dichloride in the proper portions under elevated temperatures. These compounds can be thereafter reacted with phosphorus pentoxide, an alkali or alkaline earth metal base or an amine.

Another class of sulfur-containing antioxidants particularly useful in the practice of this invention is the reaction product of an alkylphenol mercaptobenzothiazole and an aldehyde, such as formaldehyde. If additional sulfur is desired in the antioxidant composition, the product may be reacted with a sulfurizing agent such as sulfur monochloride, sulfur, phosphorus pentasulfide, and the like. These antioxidant compounds are more specifically described in U.S. Pat. No. 3,846,318.

A particularly useful sulfurized compound because of its multifunctional properties is a sulfurized metal phenate. These compounds are prepared by reacting an alkylphenol with sulfur and an alkaline earth metal base (e.g., calcium hydroxide, barium hydroxide, calcium oxide, etc.) in the presence of a mutual solvent. The resulting compounds have a generalized structural formula as follows:

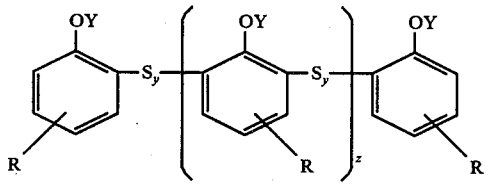

wherein R is an alkyl group having from 8 to 35 carbons; $y$ is an integer from 1 to 5; $z$ is an integer from 0 to 15; Y is the same or different substituent selected from H or ½ M where the ratio of H to ½ M is proportional to the ratio of M to alkylphenol reacted; and M is an alkaline earth metal.

The above formula represents a broad and simplified version of the sulfurized compounds, and it should be recognized that minor amounts of comounds not defined by the above equation may be present in the reaction product mixture. The mutual solvent employed in the above reaction can comprise any stable organic liquid having appreciable solubility for both the alkaline earth metal base and alkylphenol. Exemplary solvents include ethylene glycol, 1,4-butanediol, etc.

Sulfurized alkaline earth metal phenates prepared by reacting an alkylated phenol with an alkaline earth metal base to form an intermediate metal phenate which is then sulfurized may be successfully employed. These compounds are more specifically described in U.S. Pat. No. 2,360,302.

The Phosphorus-Containing-Compounds

The second component of the lubricant composition of the present invention is a phosphorus-containing compound prepared by reacting phosphorus oxychloride or phosphorus thiochloride with 1,2-substituted imidazoline in which the 1-substituent is hydroxyalkyl of 1 to 10 carbon atoms and the 2-substituent is an aliphatic hydrocarbon radical containing 6 to 24 carbon atoms or with an oil-soluble N-aliphatic-substituted amino alkylene amide of a higher fatty acid containing a terminal hydroxy group in the aliphatic substituent, said alkylene containing 2 to 5 carbon atoms and said aliphatic radical containing from 1 to 10 carbon atoms, or mixtures thereof. It is believed that the compounds have the generalized structure shown in Formula (I) below:

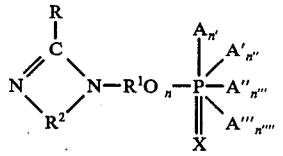

(I)

wherein X is the same or different element selected from oxygen or sulfur, preferably oxygen;

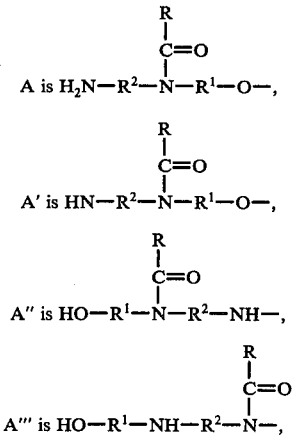

R is a $C_6$–$C_{24}$ hydrocarbyl, preferably a $C_{13}$–$C_{17}$ hydrocarbyl;

$R^1$ is a $C_1$–$C_{10}$ hydrocarbylene, preferably a $C_2$–$C_6$ alkylene;

$R^2$ is $C_2$ alkylene;

and each of n, n′, n″, n‴ and n⁗ is independently zero, one, two or three, and the sum of n, n′, n″, n‴ and n⁗ is three.

As referred to herein, "hydrocarbylene" is a divalent organic radical and "hydrocarbyl" is a monovalent organic radical, each being composed essentially of hydrogen and carbon and may be aliphatic, aromatic or alicyclic, or combinations thereof. The hydrocarbylene and hydrocarbyl may be saturated or ethylenically unsaturated (one or more double-bonded carbons, conjugated or nonconjugated). The preferred hydrocarbylene is an alkylene. The preferred hydrocarbyl is alkyl. Although the hydrocarbylene and hydrocarbyl groups are essentially hydrogen and carbon, these groups can also contain other functional groups such as halo, keto, etc., on or within the R, $R^1$ or $R^2$ chain with less than 10%, and preferably less than 5%, of the available sites being substituted.

The reaction of the phosphorus oxychloride or phosphorus thiochloride with the imidazoline or amide reactant can be conducted noncatalytically by merely contacting the two reactants within a suitable reaction vessel at a temperature from 50° to 200° C, and preferably from 75° to 150° C. The reaction pressure is not critical except that it is preferred to apply sufficient pressure on the system to maintain liquid-phase conditions. Generally, the pressure will range from 1.0 to 3 atmospheres, and preferably is 1 atmosphere. The phosphate esters may be prepared by either a batch or continuous processing scheme. In a typical batch process, a reaction vessel, preferably constructed or lined with a corrosive resistant material, is charged with a suitable inert reaction solvent and either a 1,2-substituted imidazoline in which the 1-substituent is hydroxyalkyl of 1 to 10 carbon atoms and the 2-substituent is an aliphatic hydrocarbon radical containing 6 to 24 carbon atoms or an oil-soluble N-aliphatic-substituted amino alkylene amide of a higher $C_6$–$C_{24}$ fatty acid containing a terminal hydroxy group in the aliphatic substituent, said alkylene containing 2 to 5 carbon atoms and said aliphatic radical containing 1 to 10 carbon atoms, or mixtures thereof.

The contents of the reactor are stirred to disperse the reactants within the reaction solvent. Phosphorus oxychloride or thiochloride is then introduced into the reaction vessel in contact with the other reactant. The reaction takes place upon the contact of these reactants to produce the phosphate ester. The addition rate of the phosphorus oxychloride or thiochloride to the reactor is not critical to the practice of this invention and only provides a convenient method for introducing the phosphorus reactant into the system. Phosphorus oxychloride or thiochloride may be charged to the reaction vessel before the other reactant, or in an alternative embodiment, the reactants may be charged to the vessel in an intermittent manner.

During the course of the reaction, hydrogen chloride is released as a by-product. This by-product can be stripped from the reaction medium during or after the completion of the reaction. While stripping may be a convenient method for removing the by-product hydrogen chloride, the conditions employed during the stripping in many instances have an adverse effect on the product. Therefore, it is preferred to complex and neutralize the hydrogen chloride within the reaction medium simultaneous with its formation. It has been found that the complexing or neutralization step can be accomplished by mixing a stable basic compound or acid acceptor within the reaction medium. Exemplary acid acceptors include $C_1$–$C_{20}$ trialkylamines such as trimethylamine, triethylamine, tripropylamine, triisopropylamine, tributylamine, etc., basic heterocyclic nitrogen compounds such as pyridine, quinoline, picoline, pyrazine, etc., as well as basic metal compounds. The preferred acid acceptors are the trialkylamines and the heterocyclic nitrogen-containing compounds, since water is not produced in the neutralization of hydrogen chloride by-product. The presence of water in the system is to be avoided since it may react with the phosphorus oxychloride or phosphorus thiochloride reactant.

As discussed earlier, the reaction is preferably conducted in the presence of an inert stable reaction solvent. Exemplary reaction solvents which may be employed in the practice of this invention include $C_5$–$C_{20}$ aliphatic or aromatic hydrocarbons such as hexane, octane, nonane, benzene, toluene, naphthalene, ethylcyclohexane, etc., halogenated hydrocarbons, hydrocarbon esters, hydrocarbon ethers, etc.

The concentration of the various reactants within the reaction medium can vary over a wide range depending upon reactants chosen, the reaction conditions, vessel construction, process scheme, etc. Generally, however, the reactants will be present in the amounts shown in the following Table I.

TABLE I

| Component | Broad Range | Preferred Range |
|---|---|---|
| Acid acceptor | 1–3 equivalents | 3 equivalents |
| Phosphorus reactant | eqivalent | 1 equivalent |
| Imidazoline or amide reactant | 1–3 equivalents | 3 equivalents |

The molar ratio of the reactants introduced into the reaction medium will generally vary from one mol of phosphorus oxychloride or phosphorus thiochloride and about 1 to 3 mols of imidazoline or hydrocarbyl amide reactant. Preferably, the reactants are present in substantially stoichiometric amounts, i.e., 1 to 3 molar ratio of imidazoline and/or amide reactant to phosphorus reactant.

The imidazoline or amide reactant is prepared by reacting a $C_6$ to $C_{24}$ monocarboxylic acid with an N-hydroxyalkyl alkylene diamine. The reaction proceeds without the presence of a catalyst and at temperatures ranging from 125 to 225° C. A reaction solvent is preferably present and may be the same kind of reaction solvent as used in the reaction with the phosphorus oxychloride reactant. The reaction proceeds as follows:

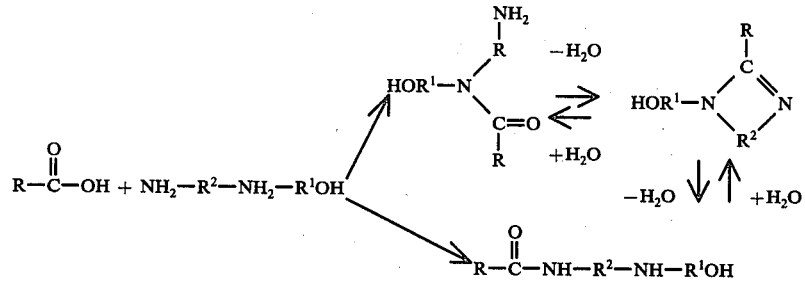

The amide and the imidazoline reactants are in equilibrium at temperatures ranging from 150° to 200° C. Accordingly, either the amide or the imidazoline or mixtures of the two may be successfully employed in the practice of this invention. The R, $R^1$ and $R^2$ groups used in the formula are defined supra. Also, mixtures of acids and N-hydroxyalkyl alkylene diamine may be employed so that R or $R^1$ or $R^2$ or all three may have several carbon lengths existent within the composition at the same time. The preparation of the imidazoline and amides is disclosed in U.S. Pat. Nos. 2,974,022, 2,839,371, 2,839,372 and 2,839,373, which patents are herein incorporated by reference.

The Oil-Soluble Zinc Salt

The class of zinc salts which may be employed in the practice of this invention includes oil-soluble zinc salts which provide in a lubricating oil solution from 9 to 40 mg of zinc per kilogram of oil.

The zinc salt is preferably a zinc dihydrocarbyl dithiophosphate having from 4 to 20 carbons in each hydrocarbyl group. The zinc dihydrocarbyl dithiophosphate is formed by reacting the coresponding dihydrocarbyl dithiophosphoric acid with a zinc base such as zinc oxide, zinc hydroxide, and zinc carbonate. The hydrocarbyl portions may be all aromatic, all aliphatic, or mixtures thereof.

Exemplary zinc dihydrocarbyl dithiophosphates include:

zinc di(n-octyl) dithiophosphate
zinc butylisooctyl dithiophosphate
zinc di(4-methyl-2-pentyl) dithiophosphate
zinc di(tetrapropenylphenyl) dithiophosphate
zinc di(2-ethyl-1-hexyl) dithiophosphate
zinc di(isooctyl) dithiophosphate
zinc di(hexyl) dithiophosphate
zinc di(ethylphenyl) dithiophosphate
zinc di(amyl) dithiophosphate
zinc butylphenyl dithiophosphate
zinc di(octadecyl) dithiophosphate Preferred compounds are those zinc dihydrocarbyl dithiophosphates having from 4 to 18 carbon atoms in each hydrocarbon group and especially zinc dialkyl dithiophosphates wherein each alkyl group typically contains from 4 to 8 carbon atoms.

The lubricant composition is prepared by simply admixing through conventional mixing techniques, the appropriate amount of antioxidant and the phosphorus-containing compound within a suitable lubricating oil. The selection of the particular base oil, antioxidant and phosphorus-containing compound as well as the amounts and ratios of each, depends upon the contemplated application of the lubricant and the presence of other additives. Generally, however, the amount of oil-soluble antioxidant employed in the lubricating oil will vary from 0.25 to 10 and usually from 0.25 to 2 weight percent in most applications and the phosphorus-containing compound will range from 0.01 to 2 and usually from 0.01 to 0.3, preferably 0.05 to 0.3, weight percent based on the weight of the final composition. The weight ratio or organic oil-soluble antioxidant to phosphorus-containing compound will generally vary from 5 to 20:1 and usually from 10 to 20:1.

The lubricating oil which may be employed in the practice of this invention includes a wide variety of hydrocarbon oils such as naphthenic-base, paraffin-base and mixed-base oils. Other oils include lubricating oils derived from coal products and synthetic oils, e.g., alkylene polymers (such as polypropylene, butylene, etc., and mixtures thereof), alkylene oxide-type polymers (e.g., alkylene oxide polymers prepared by polymerizing alkylene oxide such as ethylene oxide, propylene oxide, etc., in the presence of water or alcohol, e.g., ethyl alcohol), carboxylic acid esters (e.g., those which were prepared by esterifying carboxylic acids such as adipic acid, azelaic acid, suberic acid, sebacic acid, alkenylsuccinic acid, fumaric acid, maleic acid, etc., with an alcohol such as butyl alcohol, hexyl alcohol, 2-ethylhexy alcohol, pentaerythritol, etc., liquid esters of phosphorus, such as trialkyl phosphate (tricresyl phosphate), etc., alkylbenzenes, polyphenyls (e.g., biphenyls and terphenyls), alkylbiphenyl ethers, esters and polymers of silicon, e.g., tetraethyl silicate, tetraisopropyl silicate, hexyl(4-methyl-2-pentoxy) disilicate, poly(methyl)siloxane and poly(methylphenyl) siloxane, etc. The lubricating oils may be used individually or in combinations whenever miscible or whenever made so by use of mutual solvents. The lubricating oils generally have a viscosity which ranges from 50 to 5000 SUS (Saybolt Universal Seconds) and usually from 100 to 1500 SUS at 100° F.

In addition to the antioxidant and the phosphorus-containing compound, other additives may be successfully employed within the lubricating composition of this invention without affecting its high stability and performance over a wide temperature scale. One type of additive which may be employed is a rust inhibitor. The rust inhibitor is employed in all types of lubricants to suppress the formation of rust on the surface of metallic parts. Exemplary rust inhibitors include sodium nitrite, alkenyl succinic acid and derivatives thereof, alkyl thioacetic acid and derivatives thereof, polyglycols and derivatives thereof, alkoxylated amines and derivatives thereof, etc.

Another type of lubricating additive which may be employed in the compositions of this invention is ashless dispersants and detergents. Typical compositions included within this class are the conventional succinimides, succinates, hydrocarbylalkylene polyamines, alkaline earth metal salts of alkyl aryl sulfonates, phenates, and the like.

Other types of lubricating oil additives which may be employed in the practice of this invention include antifoam agents (e.g., silicones, organic copolymers), stabilizers, antistain agents, tackiness agents, antichatter agents, dropping point improvers, antisquawk agents, lubricant color correctors, extreme-pressure agents, odor control agents, detergents, antiwear agents, thickeners, etc.

Lubricant Performance

The presence of the phosphrous-containing compound within the lubricant composition promotes the antioxidation properties of the oil-soluble, sterically hindered phenols or thiophenols, oil-soluble aromatic amines and oil-soluble organic sulfur compounds. With this combination, less of the antioxidant is necessary in the lubricant to realize the desired antioxidiation properties.

EXAMPLES

The following examples are presented to illustrate the practice of specific embodiments of this invention and should not be interpreted as limitations of the scope of this invention.

EXAMPLE 1

This example is presented to illustrate the preparation of a representative phosphate triester phosphorus-containing composition of this invention.

A reaction vessel is charged with 525 grams of 1-hydroxyethyl-2-heptadecenyl imidazoline in 500 milliliters of benzene and 231 grams of triethylamine. The mixture is stirred until homogeneous and 76.8 grams of phosphorus oxychloride ($POCl_3$) are added over a period of 30 minutes. The reaction flask is maintained at a temperature of 65° C during the addition of the phosphorus oxychloride. Thereafter, the reaction vessel was maintained at room temperature for 1.5 hours and then heated to reflux (82°-83° C) for 16 hours. The reaction mixture is diluted to 3.8 liters by the addition of benzene and allowed to stand for four days. The product is filtered to remove the triethylamine hydrochloride. The filtrate is stripped of the benzene by heating to 150° C under reduced pressure. The product weighted 573 grams and had the following analysis: P, calc. 2.8%, found 3%; N, calc. 7.6%, found 7.3%. The primary product has the formula:

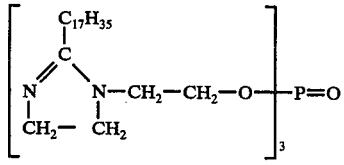

EXAMPLE 2

This example is presented to illustrate the effectiveness of the combination of a phosphorus-containing composition in improving the antioxidation properties of a lubricating oil over the use of either of the components individually. The oxidation test as employed herein uses the resistance of the test sample to oxidation of pure oxygen with a Dornte-type oxygen absorption apparatus (R. W. Dornte, "Oxidation of White Oils", *Industrial & Engineering Chemistry,* Vol. 28, p. 26, 1936). The conditions are an atmosphere of pure oxygen exposed to the test oil, maintained at a temperature of 340° F. The time required for 100 g of test sample to remove 1000 ml of oxygen is observed and reported in the following Table II.

In order to simulate the oxidation occurring in an internal combustion engine, a mixture of various soluble metal naphthenates, typifying the metal analysis frequently encountered in crankcase oils, is mixed with the test oil.

Experimental samples subjected to the above oxidation test consist of the following: Sample A, referred to herein as the base oil, is composed of a midcontinent neutral oil having a viscosity of 350 SUS at 100° F, 6%wt of a conventional succinimide dispersant, 0.05%wt terephthalic acid, and 0.4%wt of a conventional rust inhibitor. The remaining test samples contained varying amounts of a conventional diparaffin polysulfide antioxidant, a diisobornyl diphenylamine antioxidant and 1/10% of a phosphate triester produced by the method of Example 1 and, in some tests, a conventional zinc dialkyl dithiophosphate. The results of the oxidation test for the above samples are reported in the following Table II.

TABLE II

| Oxidation Test | | | | | |
|---|---|---|---|---|---|
| Base Blend plus Additives | | | | | |
| Antioxidant, % wt | | Carbonated, sulfurized | Zinc dialkyl | Product of | |
| Diparaffin polysulfide | Diisobornyl Amine | Calcium polypropylene phenate, mmol/kg | Dithiophosphate mmols/kg | Example 1 % wt | Oxidation Life, hrs |
| | | | 9 | | 5.1 |
| | | | 18 | | 6.8 |
| | | | 9 | 0.1 | 5.3 |
| | | | | | 2.6 |
| 1 | | | 9 | | 6.4 |
| 1 | | | | 0.1 | 7.9 |
| 1 | | | 9 | 0.1 | 10.3,11.0* |
| | 1 | | 9 | | 8.1 |
| | 1 | | 9 | 0.1 | 11.0 |
| 0.5 | 0.5 | | 9 | | 8.4 |
| 0.5 | 0.5 | | 9 | 0.1 | 13.0 |
| | | 20 | 9 | | 4.8 |
| | | 40 | 9 | | 4.8 |
| 1 | | 20 | 9 | 0.1 | 9.5 |
| 1 | | 40 | 9 | 0.1 | 9.2 |

*Duplicate runs

EXAMPLE 3

The resistance to increase in viscosity of lubricating oil for oils containing an antioxidant and phosphorus-containing composition as compared to oils containing each component alone is illustrated by the following engine test. In this test, an Oldsmobile engine is charged with 10.65 pounds of the oil to be tested. The engine is then started and run for 2 minutes at 850 rpm with no load. The rpm's are then increased to 1500 with a 50-pound load and 450 psi oil pressure, and the engine is run for 8 minutes. The engine is shut down with the oil circulating for 10 minutes. The oil pump is then shut down and the oil sampled after 5 minutes. This procedure is repeated until the viscosity of the oil increases 500%. The number of hours elapsed during the test is recorded.

The base oil used in this test is a midcontinent neutral oil having a viscosity of 350 SUS at 100° F, 6%wt of a conventional succinimide dispersant, 0.05%wt of terephthalic acid, and 0.4%wt of a conventional rust inhibitor. The results of this test are reported in Table III.

EXAMPLE 5

The test procedure of Example 2 was repeated using a natural gas engine oil composed of a 480 neutral oil having a viscosity of 450–480 SUS at 100° F, 6.26% of a conventional succinimide dispersant, 0.1% terephthalic acid, 1% of 4,4'-methylene bis-(2,6-di-tert-butyl) phenol and 20 mmols/kg of tricresyl phosphate. The test results are reported in Table V.

TABLE V

| Oxidation Test | |
|---|---|
| Formulation | Oxidation Life, hrs. |
| 1. Base Oil | 5.2 |
| 2. Base oil | |

TABLE V-continued

| Formulation | Oxidation Test Oxidation Life, hrs. |
|---|---|
| 0.30%wt product of Ex. 1 | 8.9 |

The above examples represent specific embodiments of the practice of the instant invention and should not be interpreted as limitations on the scope of the invention and defined by the appended claims.

What is claimed is:

1. A composition comprising: (1) an antioxidant selected from oil-soluble, sterically hindered phenols or thiophenols, oil-soluble aromatic amines, and organic sulfur compounds containing from 3 to 40 weight percent sulfur, which is present within the compund as an organic sulfide or polysulfide or mixtures thereof; and (2) a phosphorus-containing composition prepared by reacting phosphorus oxychloride or phosphorus thiochloride with a 1,2-substituted imidazoline in which the 1-substituent is hydroxyalkyl of 1 to 10 carbon atoms and the 2-substitutent is an aliphatic hydrocarbon of 6 to 24 carbon atoms, or an oil-soluble N-aliphatic-substituted aminoalkyleneamide of a higher fatty acid containing 6 to 24 carbon atoms and containing a terminal hydroxyl group in the aliphatic substitutent, said alkylene group containing from 2 to 5 carbon atoms and said aliphatic radical containing 1 to 10 carbon atoms, or mixtures thereof.

2. The composition of claim 1 wherein the weight ratio of antioxidant to phosphorus-containing composition is 1:0.001–21.

3. The composition of claim 2 wherein an antioxidant-antiwear amount of an oil-soluble zinc salt is present.

4. A lubricating oil composition comprising an oil of lubricating viscosity and an antioxidant amount of the composition of claim 1.

5. A composition of matter comprising: (1) a major portion of an oil of lubricating viscosity; (2) from 0.25 to 10 weight percent of an antioxidant selected from oil-soluble, sterically hindered phenols or thiophenols, oil-soluble aromatic amines, and organic sulfur compounds containing from 3 to 40 weight percent sulfur, which is present within the compound as organic sulfide or polysulfide, or mixtures thereof; and (3) from 0.001 to 5 weight percent of a phosphorus-containing composition prepared by reacting phosphorus oxychloride or phosphorus thiochloride with (A) a 1,2-substituted imidazoline in which the 1-substitutent is hydroxyalkyl of 1 to 10 carbon atoms and the 2-substituent is an aliphatic hydrocarbon of 6 to 24 carbon atoms, or (B) an oil-soluble N-aliphatic-substituted aminoalkyleneamide of a higher fatty acid containing 6 to 24 carbon atoms and containing a terminal hydroxyl group in the aliphatic substituent, wherein said alkylene group contains from 2 to 5 carbon atoms and said aliphatic group contains 1 to 10 carbon atoms, or mixtures thereof.

6. The composition of claim 5 which further contains from 2 to 40 mmols of zinc per kilogram of composition, present as an oil-soluble zinc salt.

7. The composition of claim 6 wherein the oil-soluble zinc salt is a zinc dihydrocarbyl dithiophosphate.

8. The composition of claim 7 wherein the oil of lubricating viscosity is present in major amounts, the antioxidant is present at a concentration of 0.25 to 2 weight percent, the zinc is present at from 9 to 30 mmols per kilogram, and the phosphorus-containing composition is present at a concentration of 0.01 to 0.3 weight percent.

9. The composition of claim 8 wherein the phosphorus-containing composition is prepared by reacting phosphorus thiochloride with 3-[hydroxy-($C_2$–$C_6$ alkyl)]-2-(C—C hydrocarbyl)-1-imidazoline or N-[hydroxy-$C_2$–$C_6$ alkyl)]-N-[amino-($C_2$–$C_6$ alkyl)]-C—C hydrocarbyl amide or mixtures thereof.

10. The composition of claim 9 wherein the oil-soluble zinc salt is a zinc dihydrocarbyl dithiophosphate having from 5 to 12 carbon atoms in each hydrocarbyl group, and the antioxidant is an aliphatic polysulfide or a sulfurized fatty acid ester.

11. The composition of claim 10 wherein the phosphorus-containing composition, prepared using phosphorus oxychloride, is present at a concentration of 0.05 to 0.3 weight percent.

12. A lubricating oil concentrate comprising a minor portion of a lubricating oil and a major amount of the composition of claim 1.

13. The composition of claim 12 wherein an antioxidant-antiwear amount of an oil-soluble zinc salt is present.

14. The composition of claim 13 wherein the oil-soluble zinc salt is a zinc dialkyldithiophosphate wherein the alkyl groups are alkyl of 4 to 8 carbon atoms.

15. The composition of claim 13 wherein the zinc salt is a zinc dihydrocarbyldithiophosphate having from 5 to 18 carbon atoms in each hydrocarbon group.

* * * * *